US006585587B2

(12) United States Patent
Falciglia, Sr.

(10) Patent No.: US 6,585,587 B2
(45) Date of Patent: Jul. 1, 2003

(54) METHOD FOR PLAYING AN ELECTRONIC VIDEO CARD GAME

(76) Inventor: Sal Falciglia, Sr., 386 Highview Ter., Ridgewood, NJ (US) 07450

( * ) Notice: Subject to any disclaimer, the term of this patent is extended or adjusted under 35 U.S.C. 154(b) by 0 days.

(21) Appl. No.: 09/867,934

(22) Filed: May 30, 2001

(65) Prior Publication Data

US 2002/0187822 A1 Dec. 12, 2002

(51) Int. Cl.[7] ..... A63F 13/00

(52) U.S. Cl. ..... 463/13; 273/292; 273/303; 463/16

(58) Field of Search ..... 273/292, 274, 273/303, 309; 463/12, 13, 25–28

(56) References Cited

U.S. PATENT DOCUMENTS 5,647,798 A 7/1997 Falciglia
5,732,950 A * 3/1998 Moody ..... 273/292
5,755,621 A * 5/1998 Marks et al. ..... 463/42
5,823,873 A * 10/1998 Moody ..... 463/13
5,868,619 A 2/1999 Wood et al.
5,882,260 A 3/1999 Marks et al.
5,897,436 A 4/1999 Singer et al.
5,954,335 A 9/1999 Moody
5,957,774 A 9/1999 Holmes, Jr. et al.
5,971,849 A 10/1999 Falciglia
5,976,016 A * 11/1999 Moody et al. ..... 463/13
6,007,066 A * 12/1999 Moody ..... 273/292
6,048,267 A * 4/2000 Wichinsky ..... 463/13
6,093,100 A 7/2000 Singer et al.
6,098,985 A * 8/2000 Moody ..... 273/292
6,120,378 A 9/2000 Moody et al.
6,146,271 A * 11/2000 Kadlic ..... 463/13
6,257,979 B1 * 7/2001 Walker et al. ..... 463/13
6,270,405 B1 * 8/2001 Ferguson ..... 463/13
6,322,445 B1 * 11/2001 Miller ..... 463/13
6,358,144 B1 * 3/2002 Kadlic et al. ..... 463/13
6,435,509 B2 * 8/2002 Wichinsky et al. ..... 273/292
6,471,587 B1 * 10/2002 Wood et al. ..... 463/13
6,474,645 B2 * 11/2002 Tarantino ..... 273/274

* cited by examiner

*Primary Examiner*—Michael O'Neill
*Assistant Examiner*—Christina M. Marks
(74) *Attorney, Agent, or Firm*—Carter, Deluca, Farrell & Schmidt, LLP

(57) ABSTRACT

The method of the present invention involves a card game in which two rows of cards are dealt to a player. Player is then provided the option to interchange cards in these hands with cards in the deck. The player makes a wager to elect to play one or more sub-hands to be constructed from the two rows of cards dealt. In one version of the game, sub-hands are constructed column-by-column whereby in a first column, a player selects none or one of the cards from the first column of the at least two rows of dealt cards for entry into a first sub-hand. The process is repeated for further elected sub-hands whereby the selection process is independent in each sub-hand. Additional cards are dealt from the deck for non-selected positions in the elected sub-hands. The poker hand ranking of each sub-hand is determined.

6 Claims, 11 Drawing Sheets

METHOD FOR PLAYING AN ELECTRONIC VIDEO CARD GAME

BACKGROUND OF THE INVENTION

1. Field of the Invention

The present invention relates generally to games, and more particularly, to a modified electronic video poker card game.

2. Description of the Related Art

The gaming industry, in particular, gambling casinos, has come to recognize that to sustain long term success it must be constantly innovative in introducing new games and new gambling concepts to the gaming public.

One game of interest over the years is poker. Table and video poker and other casino poker games are well known and enjoy substantial success. With reference to electronic video poker games, in a typical game a player makes a selected wager and initiates the play of the game. The processor of the video poker game is programmed to select from a suitable memory structure containing data representing 52 cards of a deck, data representative of a five card opening holding. These five cards are displayed face up for the player to see. The player can discard some or all of the cards whereupon the processor from the data structure replaces the discarded cards to define a final holding or hand. If the hand corresponds to a pre-determined schedule or table of poker holdings, e.g., a pair of Jacks or better, four-of a-kind, flush, the player is awarded a payoff.

Various attempts have been made to enhance play of poker over the years. There are video poker variations, such as deuces wild, where the deuces of the deck of cards are wild, Joker's wild where an additional Joker is included in the deck which is wild as well as Joker/deuces wild games. Further variations have been made over the years. Examples of such attempts are described in U.S. Pat. No. 5,882,260, Marks et al, which is incorporated herein by reference. Marks et al. provides a number of examples of U.S. patent references:

U.S. Pat. No. 4,743,022, Wood, second chance poker method; U.S. Pat. No. 4,948,134, Suttle et al., electronic five card poker game where cards are given to the players one at a time; U.S. Pat. No. 5,013,049, Tomaszewski, five card poker game where up to two cards are drawn; U.S. Pat. No. 5,118,109, Gumina, instant poker game card; U.S. Pat. No. 5,255,915, Miller, six card, two hand video poker game; U.S. Pat. No. 5,294,128, Marauez, six cards, three hand poker game; U.S. Pat. No. 5,382,025, Sklansky et al., three hands, two card poker game where each player chooses one hand and five communal cards are dealt face up; U.S. Pat. No. 5,407,199, Gumina, interactive video/casino poker game-drawpoker, hold'em poker; U.S. Pat. No. 5,415,404, Joshi et al., multiplay video poker game in which the player's sub-hands are compensated to increase the payoff level of the winning hands; and U.S. Pat. No. 5,431,407, Hofberg et al., casino poker game.

U.S. Pat. No. 5,437,451 to Fulton involves a modified poker game where the player is dealt pairs of cards, where one card is optional and the other mandatory. The player is permitted to exchange at each round the optional card until five cards are selected. The resulting five card hand is then evaluated for payoff against a fairly standard payoff table.

U.S. Pat. No. 5,314,194 to Wolf deals the player seven cards. The player then forms two hands: a five card hand (e.g., a front hand), and a two card hand (e.g., a back hand).

The rules for playing this game are quite elaborate, including requiring each player to arrange the hand so that the rank of the back hand is greater than the rank of the front hand.

Each of the prior art attempts at making poker interesting and challenging have been successful to varying degrees. Each provide a poker game that combines the attributes of skill, luck, excitement and simplicity with rapid play.

It is an objective of the present invention to provide a poker game that combines the attributes of skill, luck, excitement and simplicity with rapid play that is both unique and innovative.

SUMMARY OF THE INVENTION

The method of the present invention involves a card game in which the player plays one or more sub-hands of cards. At the start of each round of play, the player makes an initial wager to determine the number of sub-hands to be played in that round. In one embodiment, the sub-hands are constructed column-by-column, whereby cards in a particular column of a sub-hand can only be selected from cards from an associated column from two exposed hands of cards dealt at the start of a round of play. In this embodiment, at the start of a round, two hands of five-cards are dealt face-up and are column aligned card-for-card with each other and with card positions for cards defining three sub-hands to be manually constructed by the player in that round. The player manually selects none or one of the two cards from a first column of the two exposed hands for duplication into a first column position of the first sub-hand. In the case where the player has elected to place a wager to play additional sub-hands, the selection process described above is repeated for a first card position of the second and possibly third sub-hands, depending on the wagered amount. For each wagered sub-hand, the above process is repeated for the second through fifth columns. Additional cards are then dealt to each sub-hand for any unfilled positions, intentionally left unfilled by the player during the sub-hand construction process, so that each sub-hand is a completed five-card hand.

The method also includes the steps of individually comparing each hand or betting line played by the player with corresponding values in a predetermined winning schedule, and awarding the player and/or declaring the player a winner, responsive to the total value.

In alternate versions of the embodiment described above, the play of the game is modified in alternate ways, described below as versions B through E. The various alternate versions describe modifications to the basic game including: (1) providing a player with an option to interchange cards in the first and second hands with cards remaining in the deck; (2) dealing a lesser number of cards to one of the two hands of cards dealt face-up at the start of a round of play; (3) as a further variation of (2), dealing the lesser number of cards to random positions of the hand having the lesser number of cards; (4) duplicating by the player the lesser number of cards into one of an associated or non-associated column of the one or more sub-hands; and (5) starting with only a single hand of at least five cards from which one or more sub-hands are to be constructed by the player.

DETAILED DESCRIPTION OF THE PREFERRED EMBODIMENTS

The following describes the basic components and rules for playing the modified poker game according to the present invention. A card/video game with payoffs according to a predetermined payoff table is provided for a modified five card poker game.

To play the game, a single player makes a wager and is playing to obtain one or more winning outcomes. Tables I, II and III show, according to different embodiments of the present invention, a pay table of the winning outcomes which the player is striving to achieve. It is noted that in each table, certain outcomes result in no payoff. For example, referring to Table I, the outcomes "Two Pair", and "Jacks or better", result in no payoff, i.e., 0 to 1.

TABLE 1

| OUTCOME | PAYOFF |
|---|---|
| Royal Flush | 250 to 1 |
| Straight Flush | 30 to 1 |
| Four-of-a-Kind | 7 to 1 |
| Full House | 4 to 1 |
| Flush | 3 to 1 |
| Straight | 2 to 1 |
| Three-of-a-Kind | 1 to 1 |
| Two Pair | 0 to 1 |
| Jacks or better | 0 to 1 |

TABLE II

| OUTCOME | PAYOFF |
|---|---|
| Royal Flush | 250 to 1 |
| Straight Flush | 25 to 1 |

TABLE II-continued

| OUTCOME | PAYOFF |
|---|---|
| Four-of-a-Kind | 5 to 1 |
| Full House | 4 to 1 |
| Flush | 3 to 1 |
| Straight | 2 to 1 |
| Three-of-a-Kind | 1 to 1 |
| Two Pair | 0 to 1 |
| Jacks or better | 0 to 1 |

TABLE III

| OUTCOME | PAYOFF |
|---|---|
| Royal Flush | 150 to 1 |
| Straight Flush | 20 to 1 |
| Four-of-a-Kind | 5 to 1 |
| Full House | 4 to 1 |
| Flush | 3 to 1 |
| Straight | 2 to 1 |
| Three-of-a-Kind | 1 to 1 |
| Two Pair | 0 to 1 |
| Jacks or better | 0 to 1 |

Figure 1:
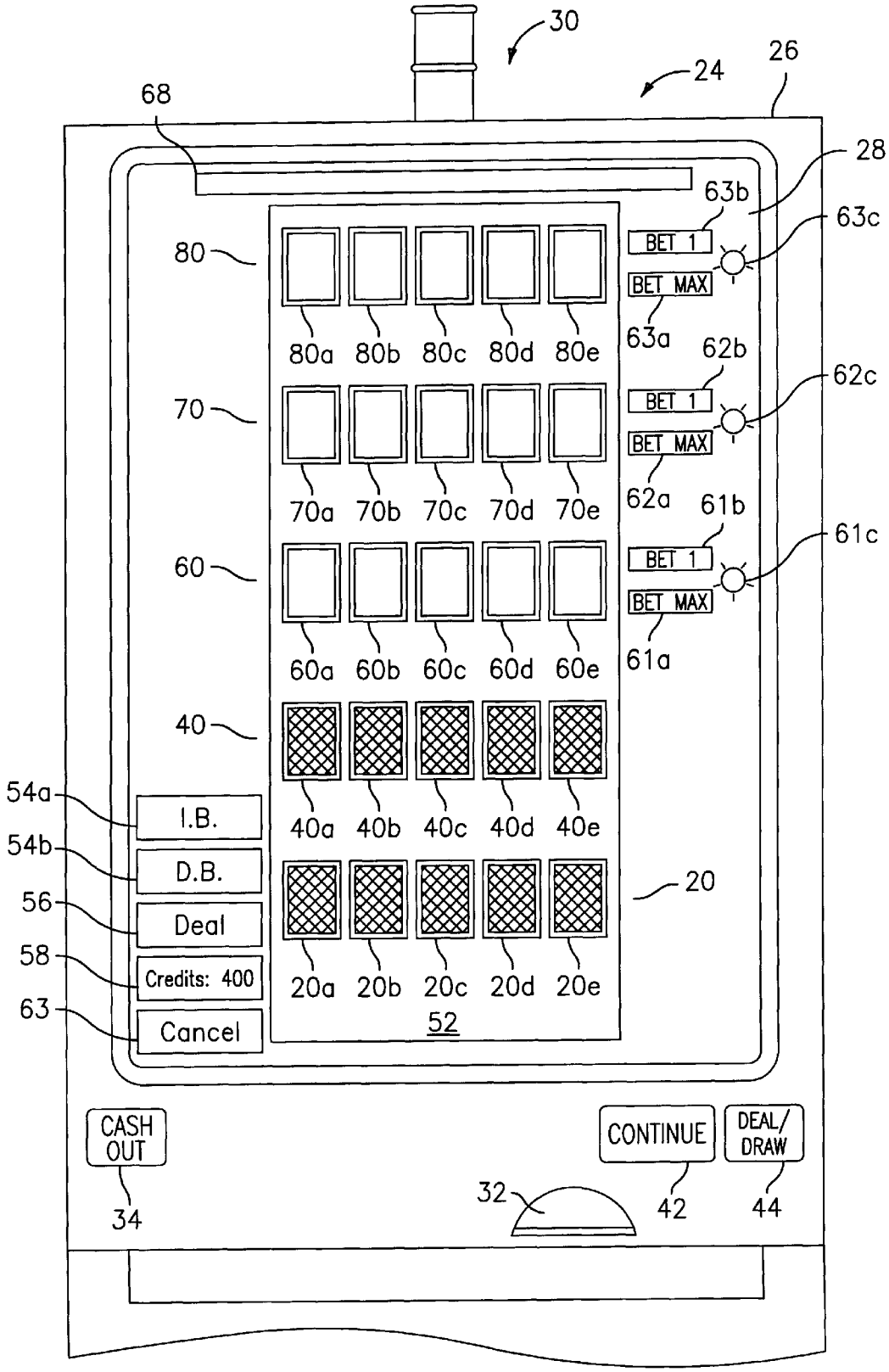
FIG. 1 shows generally a video poker machine of the type which may be used to play the game of the present invention.

With reference to FIG. 1, the video version of the method, according to the present invention, is shown. FIG. 1 shows a device 24 which includes a housing 26 of conventional design. The housing 26 contains a video display terminal or display 28 which displays the various presentations during the play of the game. In a known fashion, a candle 30 is provided for the player to signal that they need change or to indicate that the player has obtained a jackpot. The device 24 includes means for enabling the player to make a wager. These means, where the game is played for purely enjoyment, may simply be means for the player to wager fictitious credits. Alternatively, as shown in the drawings, where the device 24 is used in a gaming establishment, such as a casino, the device 24 may include a coin slot 32 by which the player can wager coins such as quarters or dollar tokens. While not illustrated, it is well known to provide a cash reader to accept cash denomination wagers; the cash reader enabling the player to accumulate credits for wagering with the device 24. Additionally, means may be provided for the player to wager from funds on a debit card or the like as known in the art.

Contained within the housing 26 is a processor (not shown) of conventional design. The processor, in the manner described below, controls the display 28 and play of the game according to the present invention using a set of programmable instructions.

With continuing reference to FIG. 1, means are provided for the player to control the play of the game and make various selections as hereinafter described. These means may be embodied as providing a touch screen display 28 or by providing a plurality of push buttons. The operations of the touch screen will now be described.

The device 24 includes a cash out button 34 to enable the player to prompt the processor to distribute to the player in a known fashion accumulated credits 58 in the form of coins or tokens. Bet one credit buttons 61*b*, 62*b*, 63*b* are provided to enable the player to wager credits from a minimum wager up to the maximum available for wagering at the device 24. Max wager buttons 61*a*, 62*a*, 63*a* enable the player to make a maximum wager to play the game and simultaneously initiate play of the game. This is conventional with present day video poker machines. Knobs 61*c*, 62*c*, 63*c* are also provided. Finally, the deal/draw button 44 enables the player to prompt the processor to initiate play where a maximum wager is not made and to complete the play of the game by completing selected sub-hands.

The processor includes a first data structure including data representing each card of a deck of 52 cards. Again, if the game is played in a Joker's wild format, the data of the first data structure would represent data of a deck of 52 playing cards plus a Joker. The processor also includes a second data structure which includes data representing winning outcome combinations of the type described in Tables I, II and III above along with the corresponding payouts. Additionally, the processor is programmed to generate the presentations at the display 28 as hereinafter described.

Furthermore, the processor includes means for determining the amount wagered by the player. This amount may be by the player wagering credits accumulated during play of the device 24 or by inserting tokens into the coin slot 32 as described above. Therefore, the processor not only receives data corresponding to the amount wagered by the player but also, as hereinafter described, contains data representing the outcome(s) obtained by the player during play of the game. This data may be useful where devices 24 are interlinked to accumulate and provide progressive jackpots.

With continuing reference to FIG. 1, initially the processor is programmed to produce a display as suggested. In the preferred embodiment, the display includes three sub-hands (betting lines) 60, 70 and 80, where each sub-hand is made up of five card positions 60*a–e*, 70*a–e*, 80*a–e*, each sub-hand being column-aligned with one other and being column-aligned with two hands dealt to the player 20*a–e*, 40*a–e* at the outset of a round of play.

Where the device 24 is adapted to receive twenty-five cent wagers to a max of three units, i.e. seventy-five cents, it is seen that because three betting lines 60, 70 and 80 are shown, each betting line has associated therewith one unit or twenty-five cents. While the description as hereinafter set forth is directed to the device 24 being a twenty-five cent machine adapted to receive wagers in increments of three units, i.e. seventy-five cents, it is to be understood that the device 24 could be adapted to receive wagers in increments of three such as $1.50, $2.25 or $3.00 or the like. Further, it is to be understood that the device 24 could be a $1.00 machine adapted to receive wagers in $3.00 increments in a like manner. The sub-hands 60, 70 and 80 and the two dealt hands 20, 40 are displayed in an action window 52 of the display 28. Each of the sub-hands 60, 70 and 80 and two dealt hands 20, 40 are column-aligned.

With reference to the touch screen display implementation of the present invention, also displayed at the display 28 are increase and decrease bet windows 54*a*,54*b* by which the player may increase or decrease their wager. By touching the screen over the increase bet window 54*a*, the player can wager a greater incremental wager. By touching the screen over the decrease bet window 54*b*, the player can reduce the wager to the minimum increment, i.e. three units. Below the increase and decrease bet windows 54*a*,54*b* is a deal window 56 by which the player may initiate play when less than the maximum amount available for wagering is made. The function of this location is similar to that of a deal/draw button 44.

Below the deal window 56 is a credit window 58 which displays the amount of credits available for the player to wager. As payouts are made, credits are added to the tally shown in the credit window 58, in a known manner.

The play of the game will now be described with reference to the device 24 which is a twenty-five cent device adapted to receive wagers in increments of three units, i.e. seventy-five cents. This description will assume that the maximum wager is made every play which is three units or seventy-five cents.

The object of the modified poker game according to the present invention is to create the highest-valued poker hands (using, for example, a video poker payoff table, such as the ones shown in Tables I, II and III or other suitable payoff table) for each of the player constructed sub-hands 60, 70 and 80. Generally, in a particular round of play, subsequent to two hands of five cards being dealt to a player, a player constructs the sub-hands 60, 70 and 80, by selecting none or one or more cards to be duplicated from each column of the two dealt hands 20, 40 to respective column-aligned positions in the three sub-hands 60, 70 and 80, as will be described by example below. A primary feature of the inventive game requires that cards can only be selected from respective columns (e.g., 20*a*, 40*a*) of the two dealt hands 20, 40 for duplication into an associated column (e.g., 60*a*, 70*a*, 80*a*) of one or more of the sub-hands 60, 70 and 80.

To play the game, the player makes a wager and touches the deal window 56 which prompts the processor to select from the first data structure data representing ten cards (i.e., two hands of five cards) and to display that data as representations of the faces of the cards 20*a–e* and 40*a–e*.

Figure 2:
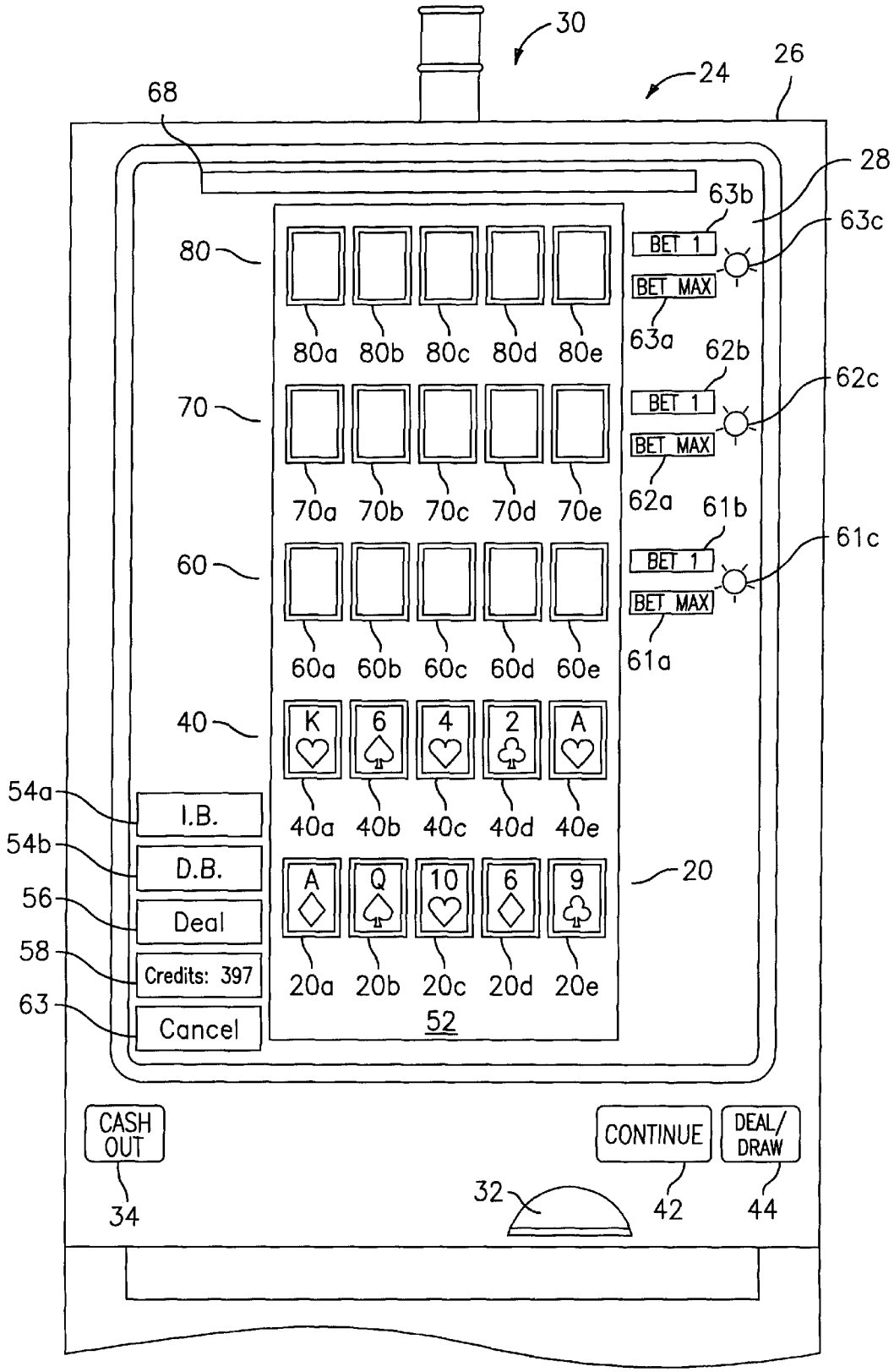
FIG. 2 shows the video terminal screen display that the player will see after the initial cards are dealt.

As shown in FIG. 2, as an illustrative example, the player has drawn an initial holding of playing cards 20*a–e* of the Ace of diamonds 20*a*, the queen of spades 20*b*, the ten of hearts 20*c*, the six of diamonds 20*d* and the nine of clubs 20*e* all displayed face up, and an initial holding of playing cards 40*a–e* of the king of hearts 40*a*, the six of spades 40*b*, the four of hearts 40*c*, the two of clubs 40*d* and the ace of hearts 40*e*. The second hand 40*a–e* is shown column aligned card-for-card over the first hand 20*a–e* in the action window 52 of the display 28.

An instruction window 68 may be provided to provide information to the player as to how to complete the play of the hand. At this point, the player may manually arrange the initial holding of playing cards 20*a–e*, 40*a–e* into three sub-hands (i.e., betting lines 60, 70, 80). The player assembles the sub-hands 60, 70, 80 by touching the selected playing cards 20*a–e* 40*a–e* and moving the cards to assemble the sub-hands 60, 70 and 80.

Figure 3:
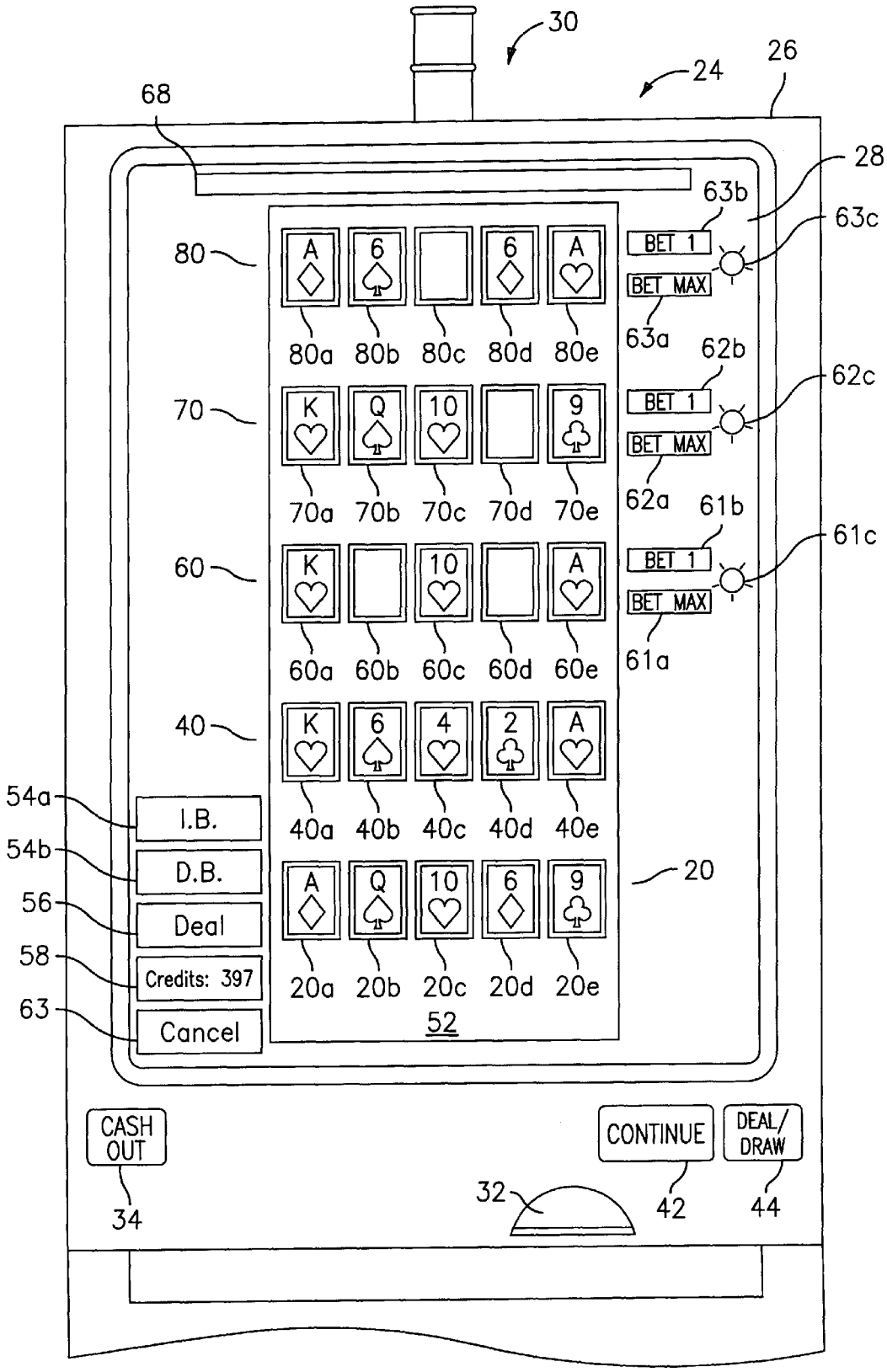
FIG. 3 shows the video terminal screen display that the player will see after the player has constructed the elected sub-hands.

With reference to FIG. 3, for the illustrative example, in the first column of the action window 52 including card positions 20*a*, 40*a*, 60*a*, 70*a*, 80*a*, it is seen that the player has arranged the playing card 20*a* (ace of diamonds), initially dealt to the player at the start of the round, into the first position 80*a* of sub-hand 80, and the playing card 40*a* into the first position 70*a* of the second sub-hand 70 and a first position 60*a* of the third sub-hand. Note that all card movements thus far are specific to the first column of the action window 52.

In the second column of the action window 52, it is seen that the player has arranged the playing card 40*b* into a second position 80*b* of sub-hand 80. In this column, the player has arranged the playing card 20*b* into a second position 70*b* of sub-hand 70. The player has also arranged to leave position 60*b* of sub-hand 60 blank.

In the third column of the action window 52, it is seen that the player has arranged the playing card 20*c* into card positions 60*c*, 70*c* of sub-hands 60 and 70, respectively. In this column, the player has elected not to select playing card 40*c* (the four of hearts) and further elects to leave position 80*c* of sub-hand 80 blank.

In the fourth column of the action window 52, it is seen that the player has arranged the playing card 20*d* into card positions 80*d*. In this column, the player has elected not to select playing card 40*d* (the two of clubs) and elects to leave position 60*d* and 70*d* of respective sub-hands 60 and 70 blank.

In the fifth column of the action window 52, it is seen that the player has arranged the playing card 40*e* (the ace of hearts) into card positions 60*e* and 80*e*. The player has also arranged the playing card 20*e* (the nine of clubs) into card position 70*e*.

If the player wishes to undo the arrangement of the sub-hands, he/she may touch the screen at cancel 63 which prompts the processor to return the display to the initial holding of FIG. 2.

Accordingly, FIG. 3 is an illustration of three sub-hands 60, 70 and 80, manually constructed by the player for a single round of play. In sub-hand 80, the player has constructed a partial hand of four cards representing two pairs (i.e., sixes and aces) in what appears to be an attempt to achieve a full-house when an additional card is dealt from the deck. In sub-hand 70, the player constructed a partial sub-hand of Nine through King, missing the Jack to complete the straight, in what appears to be an attempt to achieve a straight when an additional card is dealt from the deck. In sub-hand 60, the player constructs a partial hand comprising a Ten of Hearts, a King of Hearts, and an Ace of Hearts in what appears to be an attempt to achieve a straight flush when an additional two cards are dealt from the deck.

Figure 4:
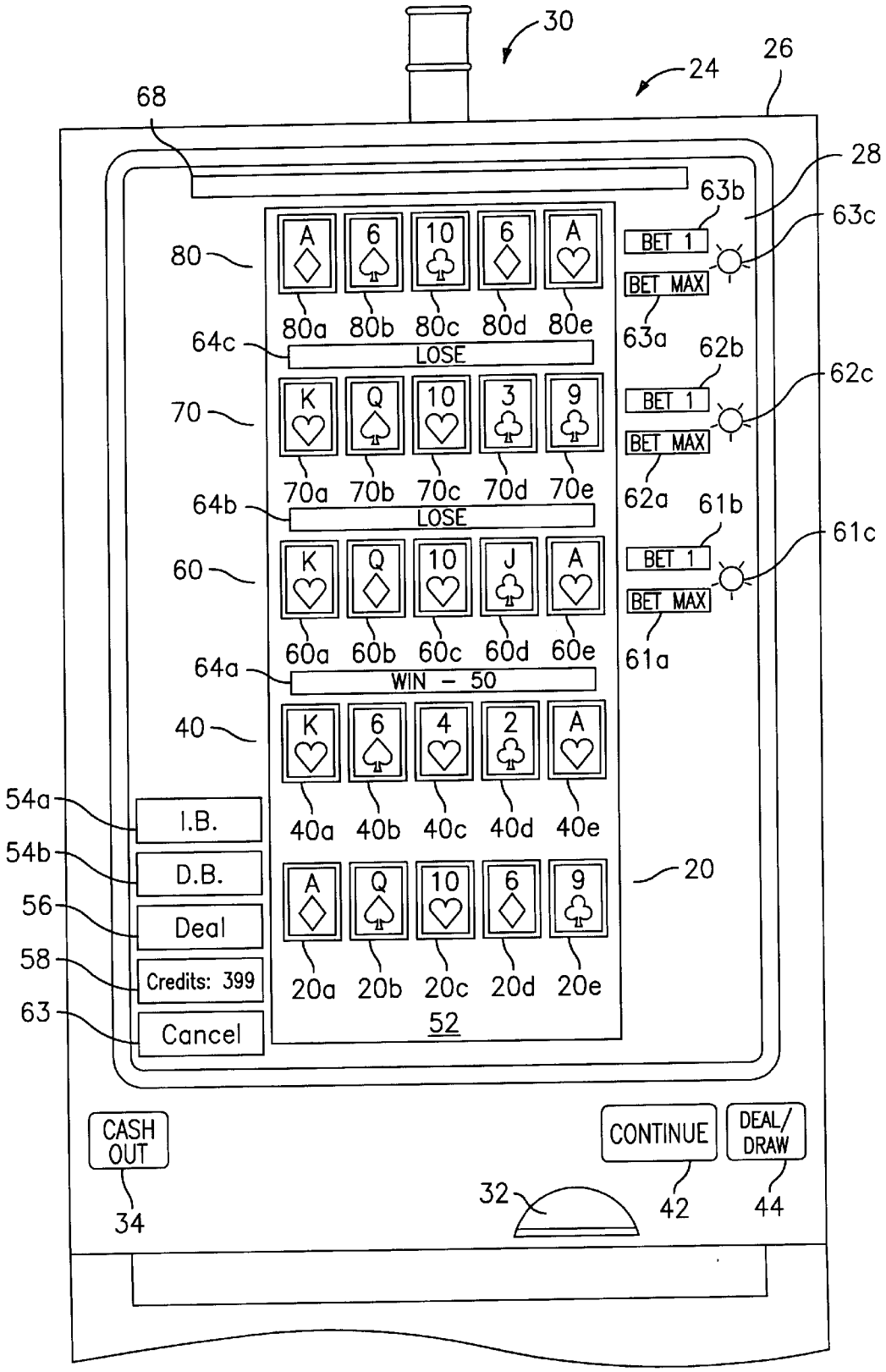
FIG. 4 shows the video terminal screen display that the player will see after additional cards are dealt to complete the elected hands.

After the sub-hands 60, 70 and 80 have been arranged, the player touches the touch screen over the deal window 56 to complete the play of the hand. Following along with the example from FIG. 3, FIG. 4 shows results that could occur. As shown in FIG. 4, the sub-hands 60, 70, 80 have now been completed. To complete the hand, the processor selects, from the remaining card data of the first data structure, card data sufficient to complete each sub-hand to a final holding of five cards each. Thus, for the first and second sub-hands 70, 80, the processor has selected one card for each sub-hand from the first data structure and for the third sub-hand 60, the processor has selected two cards. These final sub-hand combinations represent the final outcome for the hand.

It is noted that a player may fill each position of a sub-hand from one or more of the dealt sub-hands 60, 70, 80, in which case no additional cards are required from the deck to complete the sub-hand.

When the final outcomes are obtained, the processor compares the data of the cards representing the final sub-hands to the data contained in the second data structure to determine if winning outcomes have been obtained.

As illustrated in FIG. 4, sub-hand 80 contains two pairs (i.e., sixes and aces) and a ten of clubs which results in a losing outcome. Also, for sub-hand 70, the player did not achieve a winning outcome being dealt a three of clubs as the fifth card. For sub-hand 60, a winning outcome (i.e., a straight, ten to ace) is achieved for which the player is paid four units, or where in this illustration each unit is twenty-five cents, a player is paid one dollar. The processor may be prompted to display at the display 28 a banner 64*a–c* indicating the amount that has been won by the player. The processor accumulates the winning number of credits to the total credits displayed in the credit window 58. Thereafter the player is ready to play another game or redeem his credits.

As can also be seen from the display depicted in FIG. 3, the credit window 58 shows that three credits have been wagered and the initial amount of 500 credits has been appropriately debited.

The following description illustrates various alternate versions of the game. The versions are referred to with reference to the initial description of the game, referred to hereafter as Version A.

Version B: This version is played similarly to version A in that the player attempts to construct the highest valued poker hands for each of the player constructed sub-hands 60, 70 and 80, except for a modification in which in this version a player is allowed to discard at least five cards from the initially dealt hands (i.e., 20*a–e*, 40*a–e*).

Figure 5:
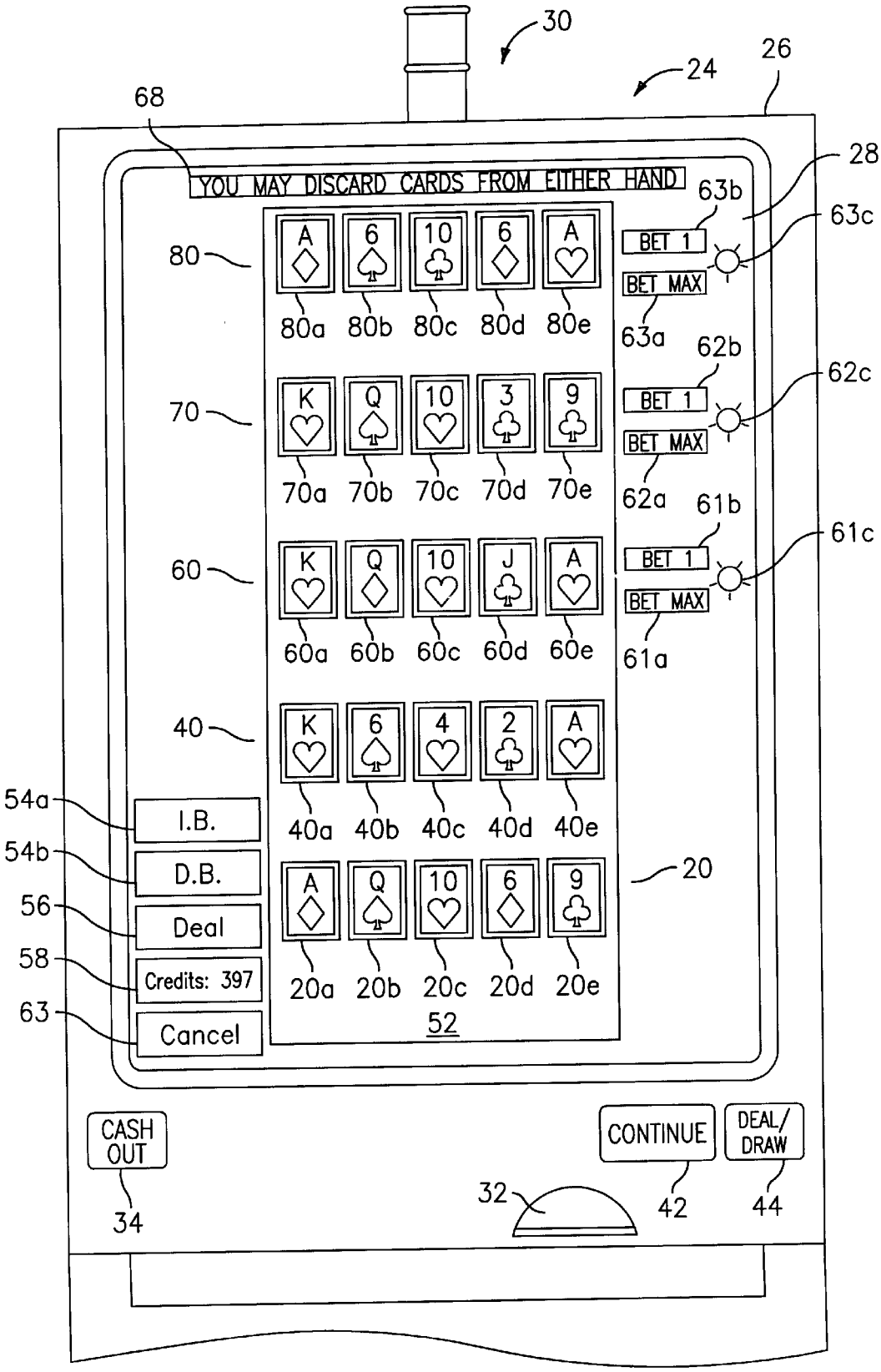
FIG. 5 shows the video terminal screen display that the player will see after the player has constructed the elected sub-hands in accordance with version B of the game.

As shown in FIG. 5, in version B the game is initiated in the same manner as described in version A. Specifically, to play the game, the player makes a separate wager on one or more of the betting lines corresponding to sub-hands 60, 70 and 80. The player then touches the deal window 56 which prompts the processor to select from the first data structure data representing ten cards (i.e., two hands of five cards) and displays the data as representations of the faces of the cards 20*a–e* and 40*a–e*.

With continued reference to FIG. 5, as an illustrative example, the player has drawn a first hand consisting of playing cards 20*a–e* including the ace of diamonds 20*a*, the queen of spades 20*b*, the ten of hearts 20*c*, the six of diamonds 20*d* and the nine of clubs 20*e* all displayed face up, and a second hand consisting of playing cards 40*a–e* including the king of hearts 40*a*, the six of spades 40*b*, the four of hearts 40*c*, the two of clubs 40*d* and the ace of hearts 40*e*. The second hand 40*a–e* is shown column aligned card-for-card over the first hand 20*a–e* in the action window 52 of the display 28.

The modification is presented to the player at this point whereby an instruction window 68 informs the player that the player has the option of discarding up to four cards from each of the first and second hands. A player discards one or more cards using conventional touch screen technology by touching the screen over the positions of the cards he wishes to discard. Alternatively, the player may touch the screen over the positions of the cards he wishes to hold.

Figure 6:
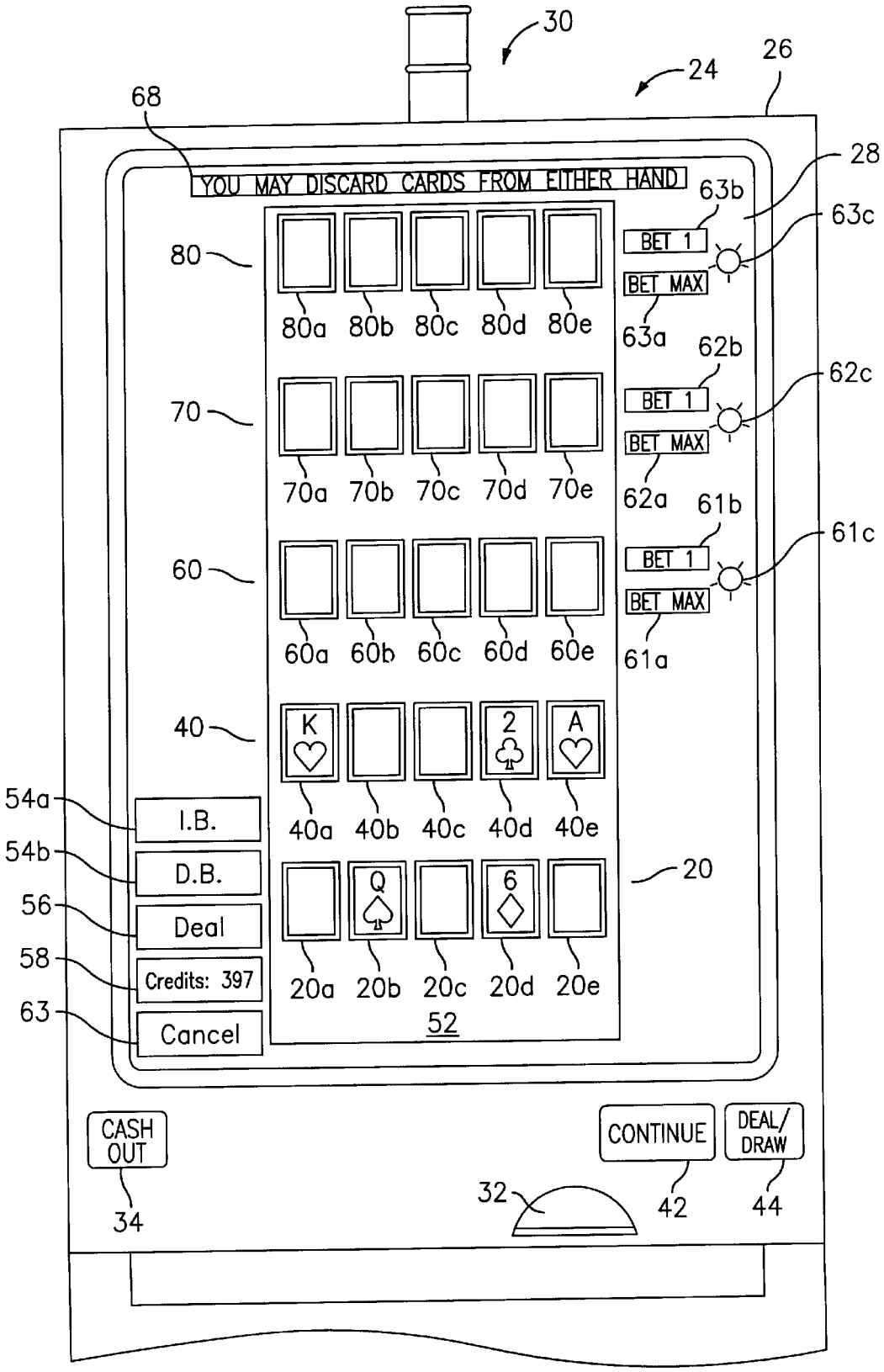
FIG. 6 shows the video terminal screen display that the player will see after electing to discard one or more cards from the elected sub-hands shown in FIG. 5 in accordance with version B of the game.

Referring now to FIG. 6, in the illustrative example, the player elects to discard from the first hand: the Ace of diamonds 20*a*, the ten of hearts 20*c*, and the nine of clubs 20*e*. Further, the player elects to discard from the second hand: the six of spades 40*b* and the four of hearts 40*c*. Following along with the example, after the player is satisfied with his choice of discarded cards, the player then touches the deal window 56 whereby the processor selects, from the remaining card data of the first data structure, card data sufficient to complete the first and second hands to a final holding of five cards each.

Figure 7:
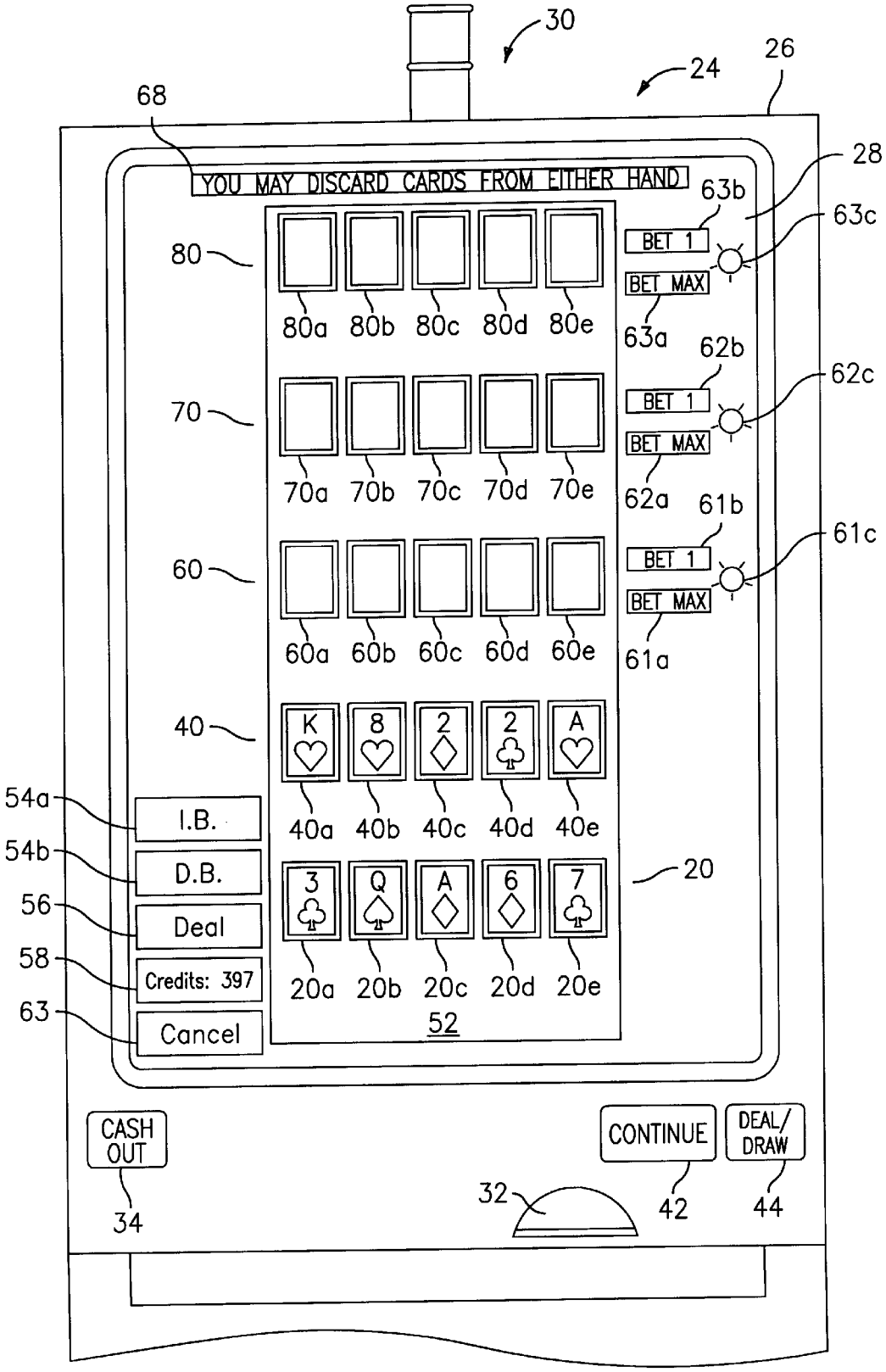
FIG. 7 shows the video terminal screen display that the player will see after additional cards are dealt to complete the elected hands in accordance with version B of the game.

FIG. 7 shows results that could occur. The resulting revised first and second hands are now played in a manner identical to that described with respect to version A.

Version C1–C4: This version is played similarly to version A in that the player attempts to construct the highest valued poker hands for each of the player constructed sub-hands 60, 70 and 80, except for a modification to the number of cards dealt to the second hand. A further optional modification provides the player with the option to interchange cards in the first and second hands prior to duplicating cards into the sub-hands. Specifically, in version C1, one card is dealt to a first position of the second hand, in version C2, two cards are dealt to the second hand 40 in positions 40*a* and 40*b*, respectively. In a similar manner, in version C3, three cards are dealt to respective positions 40*a*, 40*b* and 40*c*. Finally, in version C4, four cards are dealt to respective positions 40*a*, 40*b*, 40*c* and 40*d*.

Figure 8:
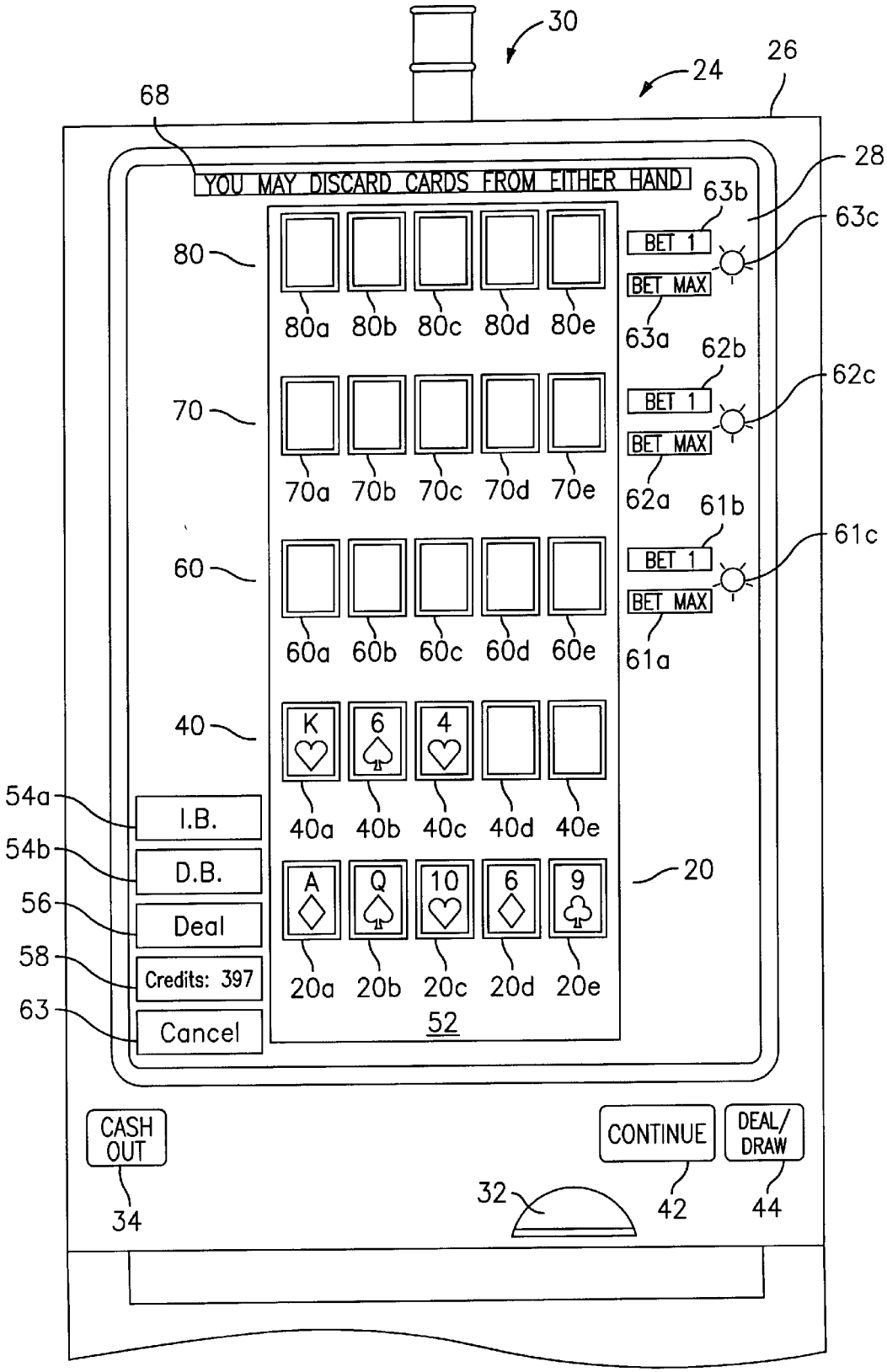
FIG. 8 shows the video terminal screen display that the player will see after the initial cards are dealt in accordance with version C1 of the game.

FIG. 8 illustrates by example version C3 wherein three cards are dealt to respective positions 40*a*, 40*b* and 40*c* of the second hand. In this version, the game is initiated in the same manner as described in version A. Specifically, to play the game, the player makes a separate wager on one or more of the betting lines corresponding to sub-hands 60, 70 and 80. The modification is presented to the player at a point after the player touches the deal window 56 which prompts the processor to select from the first data structure data representing a first hand of five cards and a second hand consisting of only three cards dealt to respective positions 40*a*, 40*b* and 40*c* of the second hand. The resulting hands are now played in a manner identical to that described with respect to version A.

Version D1–D4: Versions D1–D4 is played similarly to version A in that the player attempts to construct the highest valued poker hands for each of the player constructed sub-hands 60, 70 and 80, except for two modifications: (1) the number and manner in which cards are dealt to the second hand. Specifically, the cards are dealt to the second hand in a random fashion, (2) the manner in which a player is able to duplicate cards from the second hand 40 into the respective sub-hands 60, 70 and 80. Specifically, in versions D1–D4 each card dealt to the second hand 40*a–e* is considered a wild card. In the present context, a wild card represents a card that can be duplicated in either its associated column, as described in version A, or into a non-associated column. Versions D1–D4 correspond respectively to one, two, three, and four wild cards being dealt to the second hand.

Figure 9:
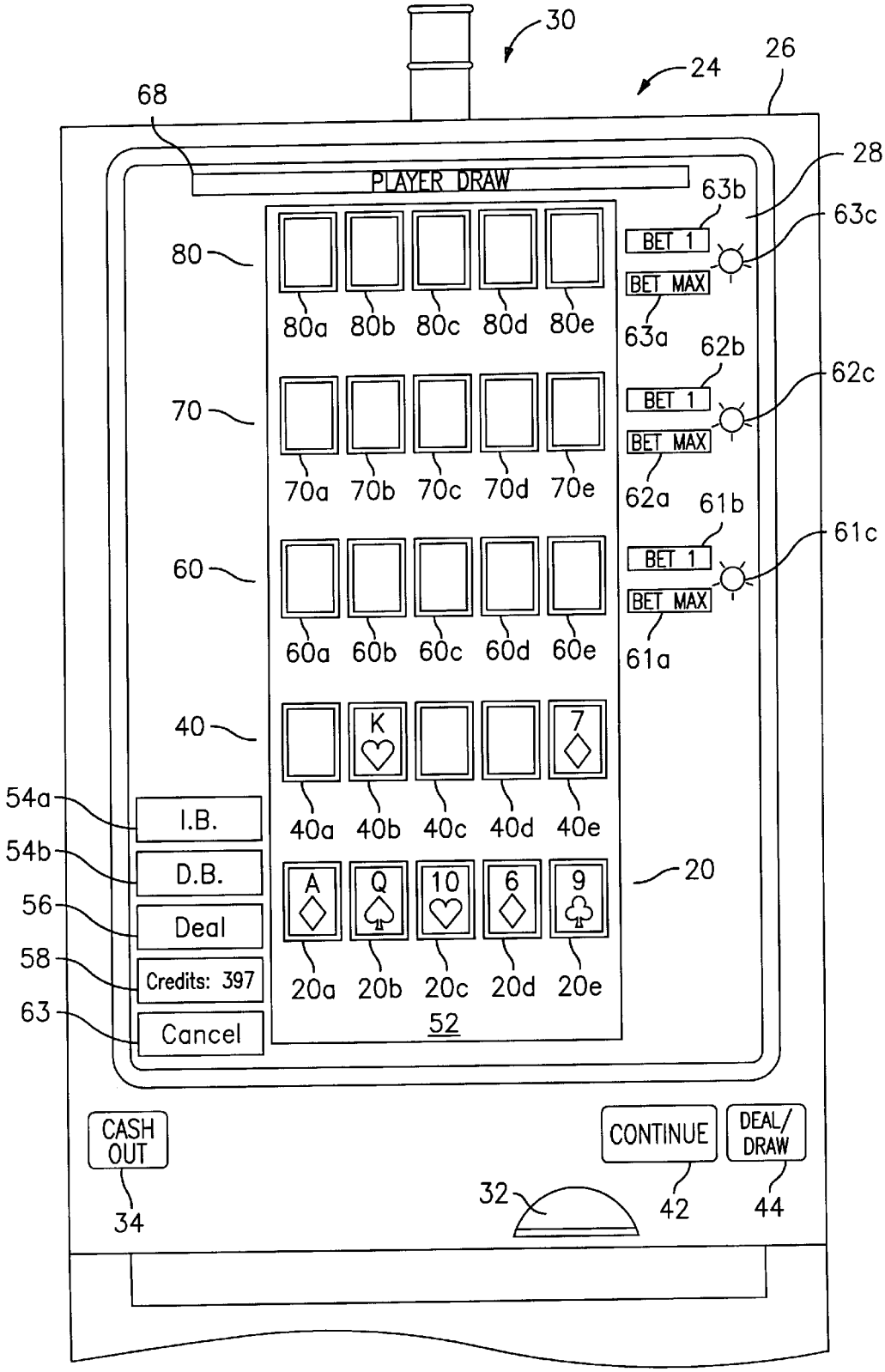
FIG. 9 shows the video terminal screen display that the player will see after the initial cards are dealt in accordance with version D2 of the game.
Figure 10:
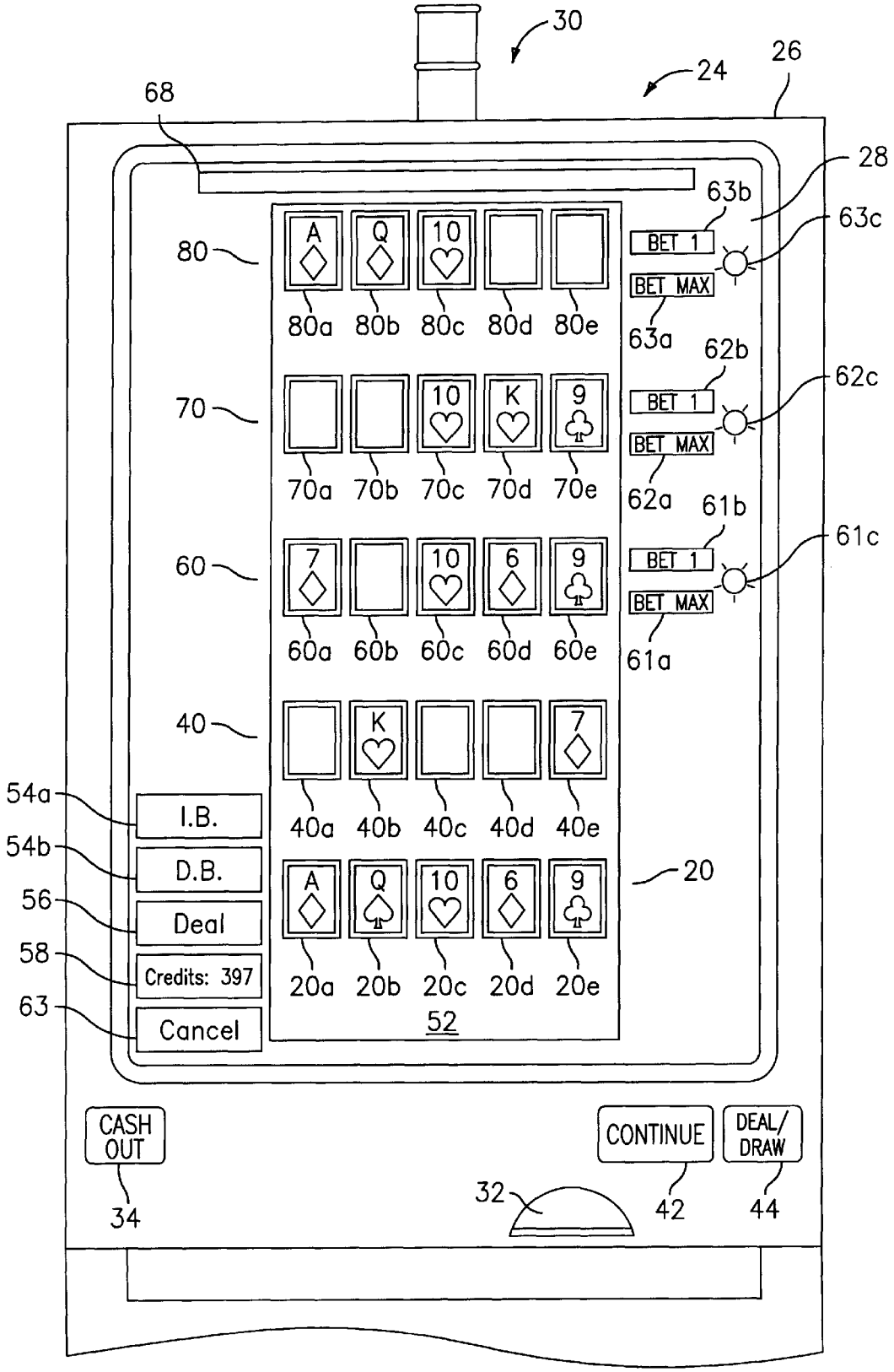
FIG. 10 shows the video terminal screen display that the player will see after the player has constructed the elected sub-hands in accordance with version D2 of the game.

FIGS. 9–10 illustrate by example version D2. In this version, the game is initiated in the same manner as described above. Specifically, to play the game, the player makes a separate wager on one or more of the betting lines corresponding to sub-hands 60, 70 and 80. The modification is presented to the player at a point after which the player touches the deal window 56 which prompts the processor to select from the first data structure data representing a first hand of five cards and a second hand of two cards.

FIG. 9 illustrates a player draw consisting of two wild cards, the king of hearts 40*b* and the seven of diamonds 40*e*, randomly dealt to the second 40*b* and fifth 40*e* positions of the second hand, respectively, and a first hand consisting of the ace of diamonds 20*a*, the queen of spades 20*b*, the ten of hearts 20*c*, the six of diamonds 20*d*, and the nine of clubs 20*e* all displayed face up. In accordance with the rules pertaining to wild cards, the player may elect to duplicate the king of hearts 40*a* into either its associated column, i.e., column 2 (i.e., 60*b*, 70*b*, 80*b*), as is the case in version A, or instead into a non-associated column in which no other wild card was dealt, e.g., columns 1, 3 or 4. In the present example, the fifth column is ineligible as a column in which the king of hearts 40*b* may be duplicated. Also, the second column is ineligible as a column in which the seven of diamonds 40*e* may be duplicated. In the present illustrative example, no wild cards were dealt to columns 1, 3 or 4 of the second hand. As such, each of these columns in the associated betting line (60, 70 and 80) is eligible for duplication of one of the wild cards dealt in columns 2 and 5.

FIG. 10 is an illustration of one possible manual construction of three sub-hands 60, 70 and 80 by the player for the illustrative game, in accordance with version D2 of the game.

Referring to FIG. 10, in sub-hand 80, the player has constructed a partial hand of three cards including the ace of diamonds 20*a* duplicated into position 80*a*, the queen of spades 20*b* duplicated into position 80*b* and the 10 of hearts duplicated into position 80*c*. No wild cards from the second hand 40 are duplicated into sub-hand 80.

In sub-hand 70, the player has constructed a partial hand of three cards including the ten of hearts 20*c* duplicated into position 70*c*, the king of hearts 40*b* (wild card) duplicated into position 70*d*, and the nine of clubs 40*e* duplicated into position 70*e*. It is noted that in accordance with the rules pertaining to wild cards, that the king of hearts 40*b* was duplicated into a non-associated column, i.e., column 4.

In sub-hand 60, the player has constructed a partial hand of four cards consisting of the seven of diamonds 40*e* duplicated into position 60*a*, the ten of hearts 20*c* duplicated into position 60*c*, the six of diamonds 20*d* duplicated into position 60*d*, and the nine of clubs 20*e* duplicated into position 60*e*. It is noted that in this sub-hand 60, the seven of diamonds 40*e* is a wild card which the player elects to duplicate into a non-associated column, column 1, while utilizing the associated column, column 5, for duplication of the nine of clubs. As is apparent, the player is utilizing the wild card rule in an attempt to form a straight, i.e., six through ten.

After the sub-hands 60, 70 and 80 have been arranged, the player touches the touch screen over the deal window 56 to complete the play of hand in an identical manner to that described with respect to version A.

Version E: Version E is played similarly to version A in that the player attempts to construct a highest valued poker hands for each of the player constructed sub-hands 60, 70 and 80, except for two modifications: (1) the number of hands initially dealt to the player, and (2) providing the player with an opportunity to discard up to 4 cards from the initially dealt hand. Specifically, in version E only a single hand of five cards is initially dealt to the player after which the player has an opportunity to discard cards in a conventional manner.

Figure 11:
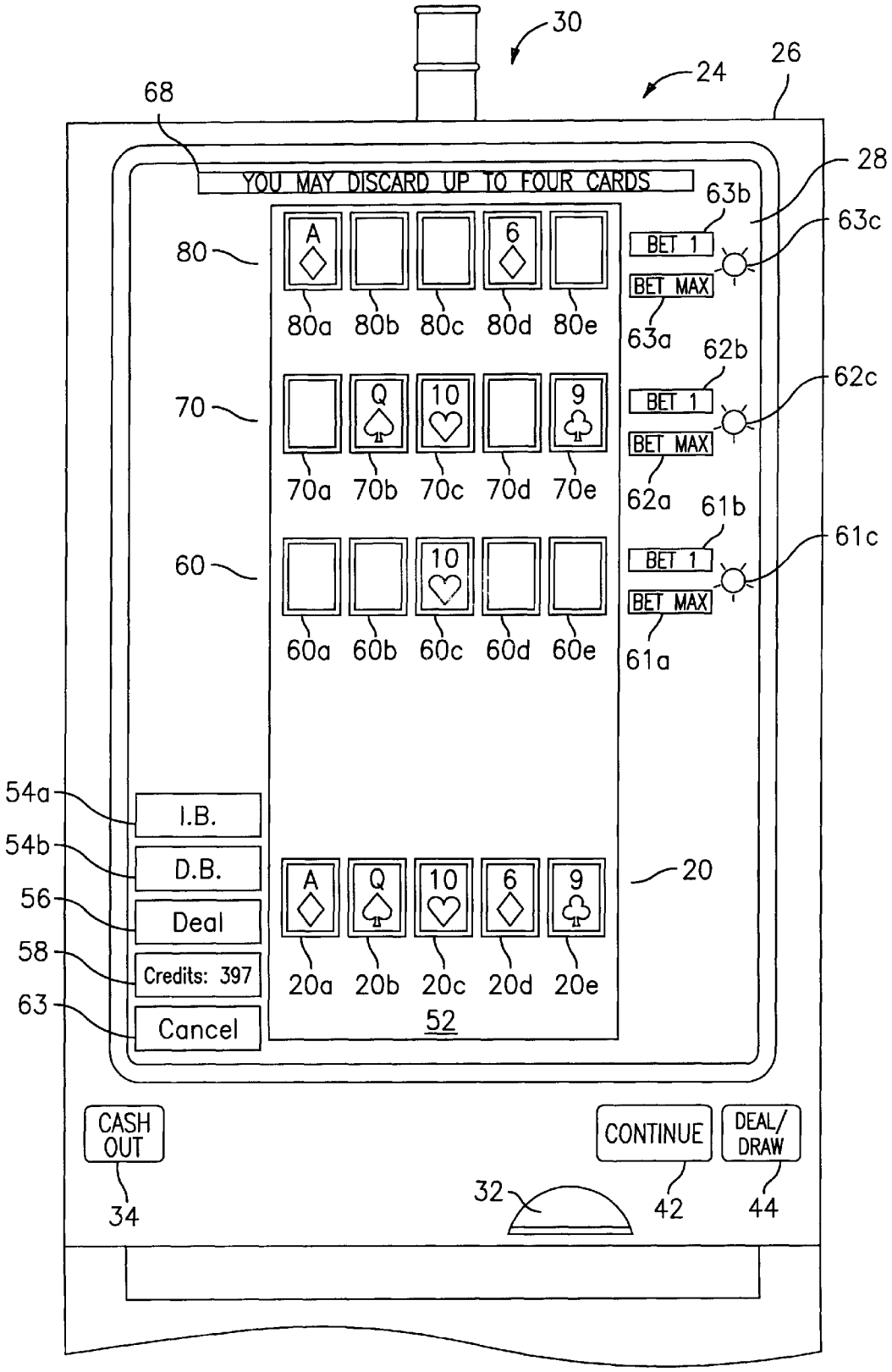
FIG. 11 shows the video terminal screen display that the player will see after the player has constructed the elected sub-hands in accordance with version E of the game.

FIG. 11 illustrates by example version E. In this version, the game is initiated in the same manner as described above. Specifically, to play the game, the player makes a separate wager on one or more of the betting lines corresponding to sub-hands 60, 70 and 80. The modification is presented to the player at a point after which the player touches the deal window 56 which prompts the processor to select from the first data structure data representing one hand of five cards.

At this point an instruction window 68 informs the player that the player has the option of discarding up to four cards from the one hand. A player discards one or more cards using conventional touch screen technology by touching the screen over the positions of the cards he wishes to discard. Alternatively, the player may touch the screen over the positions of the cards he wishes to hold. In either case, after the player is satisfied with his choice of discarded cards, the player then touches the deal window 56 which completes the one hand. To complete the one hand, the processor selects, from the remaining card data of the first data structure, card data sufficient to complete the one hand to a final holding of five cards. The resulting revised hand is now played in a manner identical to that described for version A.

It will be understood that various modifications may be made to the embodiments disclosed herein, and that the above descriptions should not be construed as limiting, but merely as exemplifications of preferred embodiments. For example, the dealt hands could be row-aligned with the sub-hands. Those skilled in the art will envision other modifications within the scope and spirit of the claims appended hereto.

What is claimed is:

1. A method of playing a card game comprising:

dealing a first hand of cards all face up from at least one deck of cards;

dealing a second hand of cards all face up from the at least one deck of cards, each of said cards of the second hand corresponding to a card of the first hand;

providing the player with an option to interchange cards in the first and second hand with cards remaining in the at least one deck of cards;

selecting from each of the corresponding pairs of cards one of one card and no cards for duplicating to a respective position of a sub-hand; and completing the sub-hand, if necessary, such that the sub-hand has an equal number of cards as a number of cards dealt to the first hand, by dealing additional cards face up from the at least one deck of cards to the sub-hand.

2. A method of playing a card game comprising:

dealing a first hand of cards all face up from at least one deck of cards;

providing the player with an option to interchange cards in the first hand with cards remaining in the at least one deck of cards;

dealing a second hand of cards all face up from the at least one deck of cards, each of said cards of the second hand corresponding to a card of the first hand;

providing the player with an option to interchange cards in the second hand with cards remaining in the at least one deck of cards;

selecting from each of the corresponding pairs of cards one of one card and no cards for duplicating to a respective position of a sub-hand; and completing the sub-hand, if necessary, such that the sub-hand has an equal number of cards as a number of cards dealt to the first hand, by dealing additional cards face up from the at least one deck of cards to the sub-hand.

3. A method of playing a card game comprising:

dealing a first hand of cards all face up from at least one deck of cards;

dealing a second hand of cards all face up from the at least one deck of cards, wherein each of said cards dealt of the second hand of cards corresponds to a card of the first hand forming at least one two-card column and at least one non-two card column, wherein said second hand of cards has less cards than the first hand of cards;

providing the player with an option to interchange cards in at least one of the first and second hands with cards remaining in the at least one deck of cards;

selecting from said one two-card column for duplication to a respective position of a sub-hand at least one of no cards from said first and second hands, a card from only said first hand, a card from only said second hand, and one card from said first hand and one card from said second hand;

selecting from said non two-card column for duplication to said sub-hand at least one of no card from said first hand, and one card from said first hand;

completing the sub-hand, if necessary, such that the sub-hand has an equal number of cards as the number of cards dealt to the first hand, by dealing additional cards face up from the at least one deck of cards to the sub-hand.

4. A method of playing a card game comprising:

dealing a first hand of cards all face up from at least one deck of cards;

dealing a second hand of cards all face up from the at least one deck of cards, wherein each of said cards dealt of the second hand of cards corresponds to a card of the first hand forming at least one two-card column and at least one non-two card column, and wherein said second hand of cards has less cards than the first hand of cards;

providing the player with an option to interchange cards in at least one of the first and second hands with cards remaining in the at least one deck of cards;

selecting from said one two-card column for duplication to a respective position of a sub-hand wherein said position constitutes any position of said sub-hand, at least one of no cards from said first and second hands, a card from only said first hand, a card from only said second hand, and one card from said first hand and one card from said second hand;

selecting from said non-two card column for duplication to said sub-hand, at least one of no cards from said first hand, and one card from said first hand; and completing the sub-hand, if necessary, such that the sub-hand has an equal number of cards as the number of cards dealt to the first hand, by dealing additional cards face up from the at least one deck of cards to the sub-hand.

5. The method of claim 4, wherein said any position is used when one card is selected from said second hand.

6. The method of claim 4, wherein the step of dealing a second hand of cards all face up from the at least one deck of cards further comprises the step of dealing cards to random positions of said second hand.

* * * * *